US006582177B1

(12) United States Patent
Westendorf et al.

(10) Patent No.: US 6,582,177 B1
(45) Date of Patent: Jun. 24, 2003

(54) FRONT END LOADER, TRACTOR, AND METHOD FOR ATTACHING A FRONT END LOADER

(75) Inventors: Neal W. Westendorf, Dakota Dunes, SD (US); Joseph W. Langenfeld, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 0 days.

(21) Appl. No.: 09/639,039

(22) Filed: Aug. 15, 2000

(51) Int. Cl.[7] ..... E02F 3/28
(52) U.S. Cl. ..... 414/686; 172/274
(58) Field of Search ..... 414/686; 172/274, 172/275

(56) References Cited

U.S. PATENT DOCUMENTS

| | | | | |
|---|---|---|---|---|
| 2,326,338 A | | 8/1943 | Drott et al. | |
| 2,812,595 A | | 11/1957 | Drott et al. | |
| 3,077,999 A | | 2/1963 | Svoboda | |
| 3,209,474 A | | 10/1965 | Artman | |
| 3,243,905 A | | 4/1966 | Ulrich | |
| 3,344,540 A | | 10/1967 | Ulrich | |
| 3,455,477 A | | 7/1969 | Blair | |
| 3,512,665 A | | 5/1970 | Westendorf | |
| 3,701,443 A | | 10/1972 | Lely | |
| 3,991,890 A | * | 11/1976 | Frank | 414/686 |
| 4,033,469 A | * | 7/1977 | Frank | 414/686 |
| 4,051,962 A | | 10/1977 | Westendorf | |
| 4,085,856 A | | 4/1978 | Westendorf | |
| 4,345,870 A | * | 8/1982 | Anderson et al. | 414/686 |
| 4,538,955 A | | 9/1985 | Langenfeld et al. | |
| 4,565,485 A | | 1/1986 | Wilman | |
| 4,566,844 A | | 1/1986 | Campin | |
| 4,606,692 A | | 8/1986 | Langenfeld et al. | |
| 4,787,811 A | | 11/1988 | Langenfeld et al. | |
| 4,790,084 A | | 12/1988 | Anderson et al. | |
| 4,797,051 A | | 1/1989 | Langenfeld et al. | |
| 4,859,130 A | | 8/1989 | Langenfeld et al. | |
| 4,890,400 A | | 1/1990 | Long | |
| 4,915,575 A | | 4/1990 | Langenfeld et al. | |
| 4,930,974 A | | 6/1990 | Langenfeld et al. | |
| 4,968,213 A | | 11/1990 | Langenfeld et al. | |
| 4,995,760 A | | 2/1991 | Probst et al. | |
| 5,121,557 A | | 6/1992 | Moore | |
| 5,387,076 A | * | 2/1995 | Fuzzen | 414/686 |
| 5,466,113 A | | 11/1995 | Norberg | |
| 5,785,328 A | | 7/1998 | Eckloff | |
| 5,997,237 A | | 12/1999 | Langenfeld et al. | |
| 6,142,724 A | * | 11/2000 | Hirooka et al. | 414/686 |

* cited by examiner

*Primary Examiner*—Donald W. Underwood
(74) *Attorney, Agent, or Firm*—Merchant & Gould P.C.

(57) ABSTRACT

A front end loader is provided according to the invention. The front end loader has a tower, a tower subframe, a knee, a loader arm, a front arm, a lift cylinder, and an attachment cylinder. The tower has a first tower end and a second tower end. The second tower end includes a shoe area for covering and attaching to a shoe-receiving region provided on a first bracket assembly attached to tractor. The tower subframe has a first tower subframe end and a second tower subframe end. The first tower subframe end is attached to the tower, and the second tower subframe end is constructed for attachment to a second bracket assembly attached to a tractor. The knee has a first knee rotation axis and a second knee rotation axis. The loader arm has a first loader arm end and a second loader arm end. The first loader arm end is rotatably attached to the first tower end of the tower. The second loader arm end is attached to the knee. The front arm has a first front arm end and a second front arm end. The first front arm end is attached to the knee. The second front arm end is rotatably connectable to an attachment. The lift cylinder has a first lift cylinder end and second lift cylinder end. The first lift cylinder end is rotatably connected to the second tower end of the tower. The second lift cylinder end is attached to the first knee rotation axis of the knee. The attachment cylinder has a first attachment cylinder end and a second attachment cylinder end. The first attachment cylinder end is attached to the second knee rotation axis of the knee, and the second attachment cylinder end is rotatably connectable to an attachment. A tractor and a method for attaching a front end load to a tractor are provided.

8 Claims, 10 Drawing Sheets

142
140
138
132
46
134
146
144
134
148
150
152

FRONT END LOADER, TRACTOR, AND METHOD FOR ATTACHING A FRONT END LOADER

FIELD OF THE INVENTION

The invention relates to a front end loader, to a tractor having a front end loader, and to a method for attaching a front end loader.

BACKGROUND OF THE INVENTION

Conventional front end loaders have a pair of booms pivotally secured at their rearward ends to the tractor and pivotally secured at their forward ends to an attachment. Typical attachments used on front end loaders include buckets, clam shells, plow, fork lift, bale spear, etc. Hydraulic cylinders are usually pivotally connected to the rearward end of the attachment. Exemplary front end loaders are described by U.S. Pat. No. 3,512,665 to Westendorf; U.S. Pat. No. 4,085,856 to Westendorf; U.S. Pat. No. 4,787,811 to Langenfeld et al.; U.S. Pat. No. 4,051,962 to Westendorf; U.S. Pat. No. 4,606,692 to Langenfeld et al.; and U.S. Pat. No. 4,930,974 to Langenfeld et al.

SUMMARY OF THE INVENTION

A front end loader is provided according to the invention. The front end loader has a tower, a tower subframe, a knee, a loader arm, a front arm, a lift cylinder, and an attachment cylinder. The tower has a first tower end and a second tower end. The second tower end includes a shoe area for covering and attaching to a shoe-receiving region provided on a first bracket assembly attached to tractor. The tower subframe has a first tower subframe end and a second tower subframe end. The first tower subframe end is attached to the tower, and the second tower subframe end is constructed for attachment to a second bracket assembly attached to a tractor. The knee has a first knee rotation axis and a second knee rotation axis. The loader arm has a first loader arm end and a second loader arm end. The first loader arm end is rotatably attached to the first tower end of the tower. The second loader arm end is attached to the knee. The front arm has a first front arm end and a second front arm end. The first front arm end is attached to the knee. The second front arm end is rotatably connectable to an attachment. The lift cylinder has a first lift cylinder end and second lift cylinder end. The first lift cylinder end is rotatably connected to the second tower end of the tower. The second lift cylinder end is attached to the first knee rotation axis of the knee. The attachment cylinder has a first attachment cylinder end and a second attachment cylinder end. The first attachment cylinder end is attached to the second knee rotation axis of the knee, and the second attachment cylinder end is rotatably connectable to an attachment.

A tractor is provided according to the invention. The tractor includes the front end loader having the second tower end attached to the first bracket assembly, and the second tower subframe end attached to the second bracket assembly. The first bracket assembly and the second bracket assembly are attached to the tractor.

A method for attaching a front end loader to a tractor is provided according to the invention. The method includes a step of driving a tractor into a stationary front end loader, and then attaching the second tower end to the first bracket assembly, and attaching the second tower subframe end to the second bracket assembly.

DETAILED DESCRIPTION OF THE PREFERRED EMBODIMENT

Figure 1:
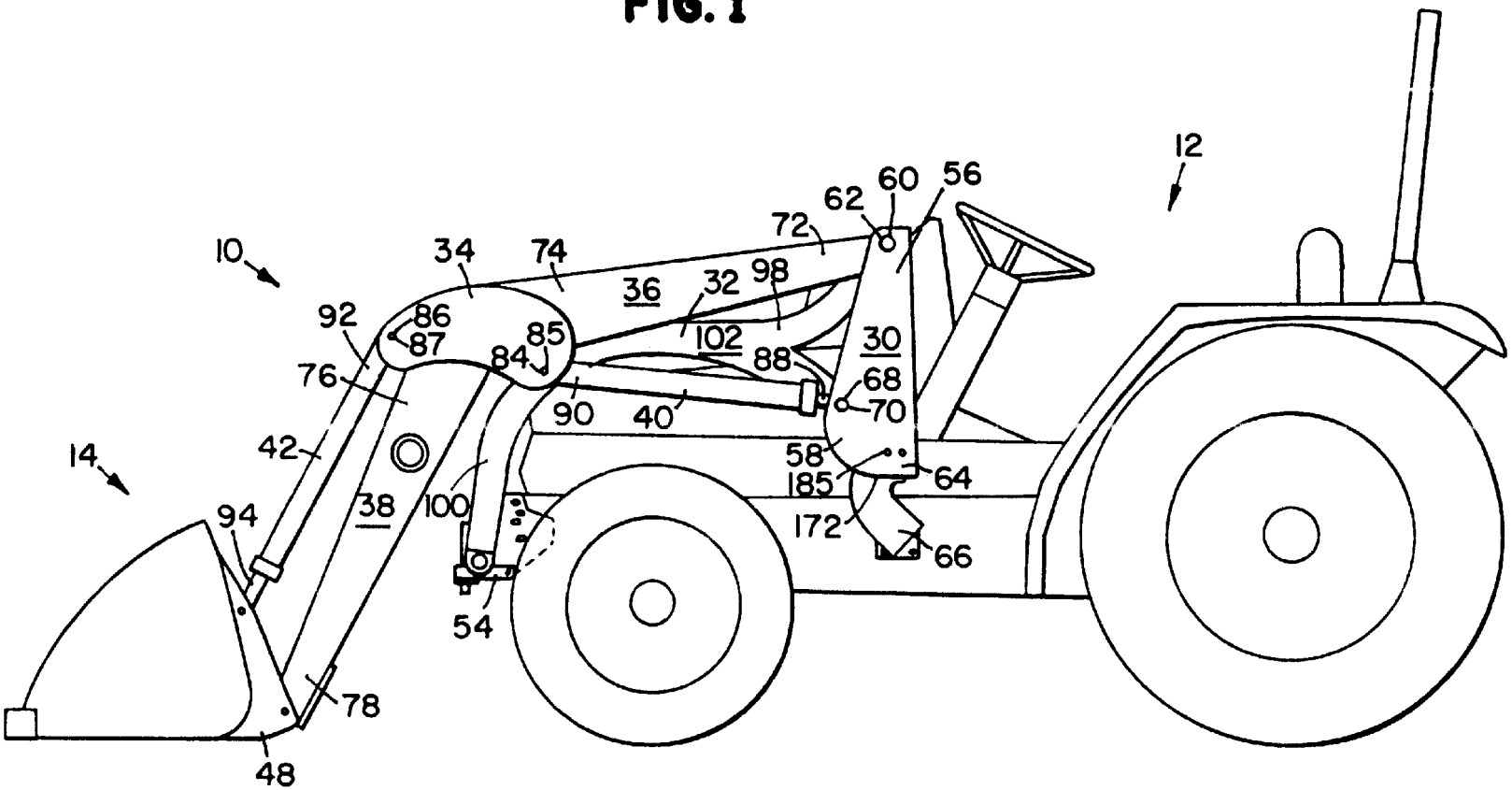
FIG. 1 is a side view of a tractor having a front end loader mounted thereon according to the principles of the invention.
Figure 2:
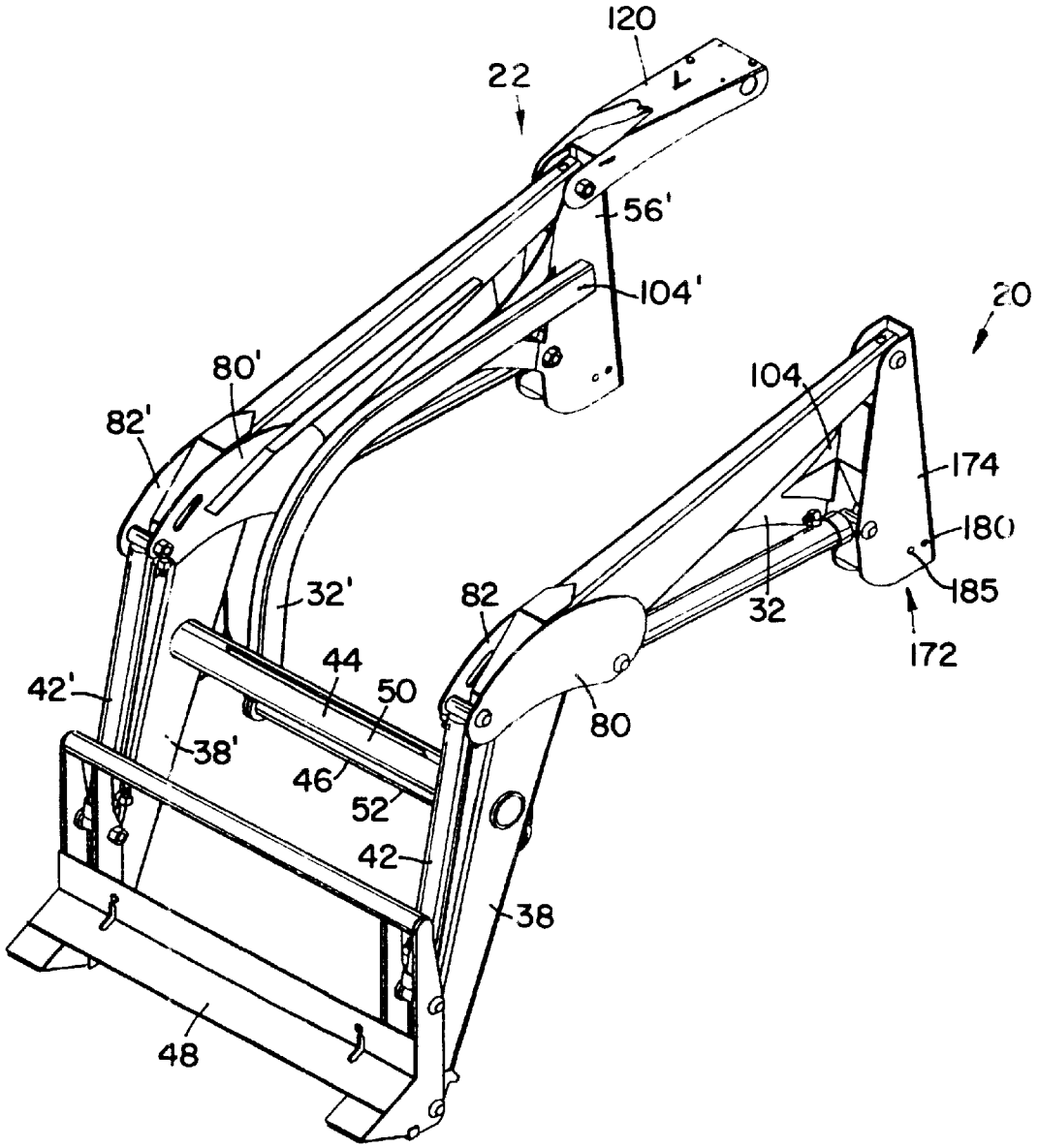
FIG. 2 is a perspective view of the front end loader of FIG. 1.
Figure 3:
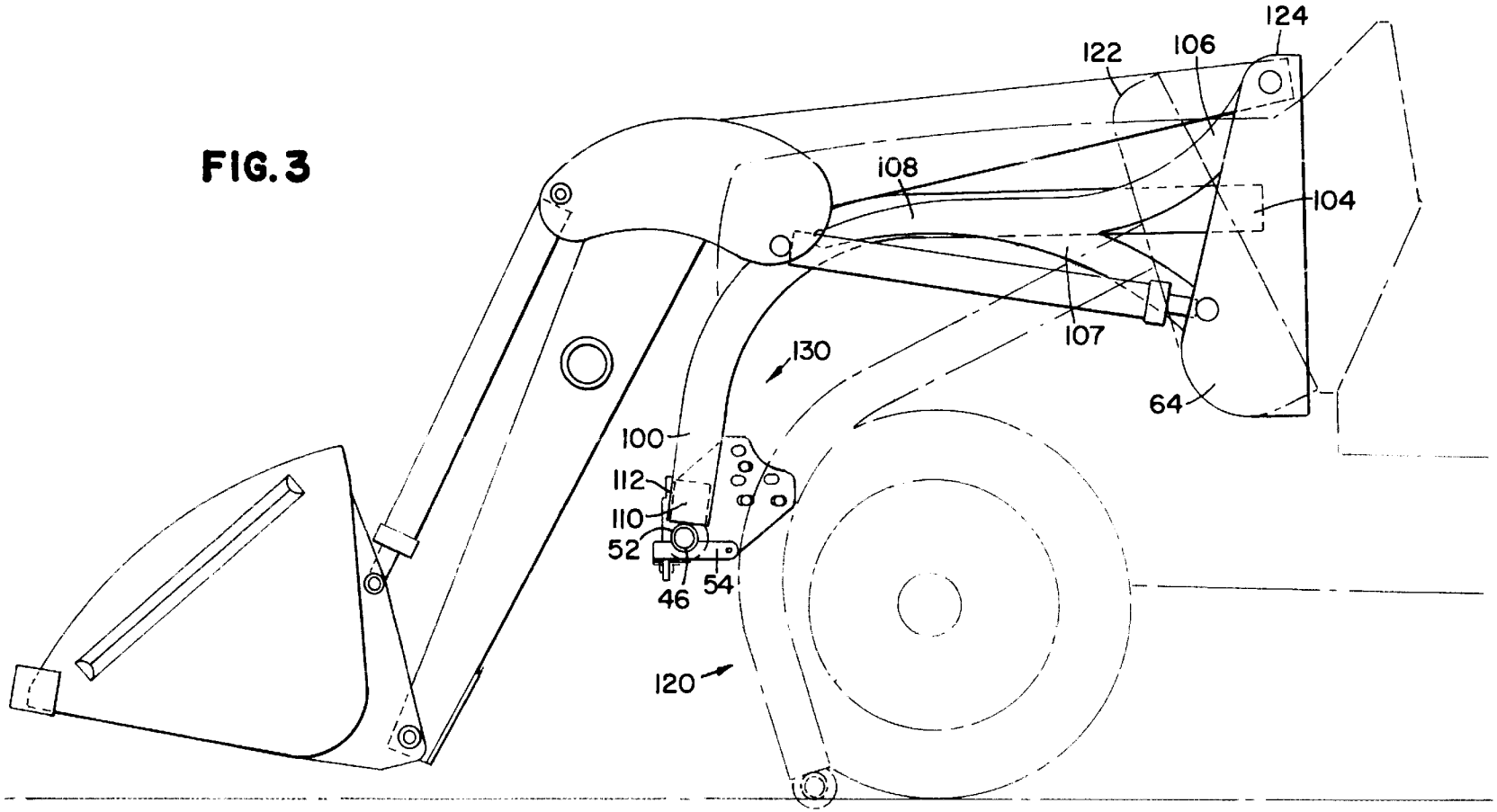
FIG. 3 is a side view demonstrating the attachment and detachment of the front end loader of FIG. 1.

A front end loader according to the invention is shown in FIGS. 1–3 at reference numeral 10. The front end loader 10 is shown attached to a tractor 12 and an attachment 14. The attachment 14 is shown as a bucket 16. The attachment 14 can be any other conventional attachment for use on a front end loader. Exemplary attachments include plows, forklifts, bale spears, clam shell buckets, etc. The front end loader 10 can be referred to more simply as the loader.

As shown in FIG. 2, the front end loader 10 includes a left boom arm 20 and a right boom arm 22 that generally include corresponding structure. The left boom arm 20 and the right boom arm 22 can be referred to as the first boom arm 20 and the second boom arm 22. There may be certain differences between the structure of the left boom arm 20 and the right boom arm 22. In general, the following discussion will refer to structure that is present on both the left boom arm 20 and the right boom arm 22. Corresponding structure, when identified, will be characterized on the right boom arm 22 using the same reference number used on the left boom arm 20, except that the reference numerals identifying corresponding structure on the right boom arm 22 will include an apostrophe.

The loader 10 includes a tower 30, a tower subframe 32, a knee 34, a loader arm 36, a front arm 38, a lift cylinder 40, and an attachment cylinder 42. As shown in FIG. 2, each of these components is provided on the left boom arm 20 and the right boom arm 22. As shown in FIG. 2, the left boom arm 20 and the right boom arm 22 are connected together by the stabilizing arm 44, the attachment arm 46, and the attachment device 48. The stabilizing arm 44 is preferably a pipe 50 that extends between the front arm 38 and the front arm 38'. The attachment arm 46 is preferably a pipe 52 extending between the tower subframe 32 and the tower subframe 32'. The attachment device 48 attaches the front arm 38 and 38' and the attachment cylinder 42 and 42' to the attachment 14. Although the front end loader 10 is shown having the attachment device 48, it should be appreciated that the front end loader 10 can be attached directly to an attachment 14 without the use of the attachment device 48. The attachment device 48 is desirable because it provides quick attaching and detaching to various attachments normally found on front end loaders.

The tower 30 and the tower subframe 32 are attached together. The tower 30 includes a first tower end 56 and a second tower end 58. The first tower end 56 includes an axis 60 for rotatable attachment to the loader arm 36. The axis 60 preferably includes a pin 62 that allows for rotation of the loader arm 36. The second tower end 58 includes a shoe area 64 for attachment of the tower 30 to the rear bracket assembly 66 that is attached to the tractor 12. The second tower end 58 additionally includes an axis 68 for rotatable attachment to the lift cylinder 40. Preferably, the axis 68 includes a pin 70 that allows rotation between the tower 30 and the lift cylinder 40.

The loader arm 36 includes a first loader arm end 72 and a second loader arm end 74. The first loader arm end 72 is rotatably attached to the first tower end 56 about the axis 60. The second loader arm end 74 is attached to the knee 34.

The front arm 38 includes a first front arm end 76 and a second front arm end 78. The first front arm end 76 is attached to the knee 34. The second front arm end 78 is provided for attaching to the attachment 14. Preferably, the second front arm end 78 is provided for attaching to the attachment device 48 that then attaches to the attachment 14.

The knee 34, the loader arm 36, and the front arm 38 are attached together to provide a structure that is sufficient to support the stresses normally encountered during the operation of a front end loader. As shown in FIG. 2, the knee 34 includes a first plate 80 and a second plate 82. The second loader arm end 74 and the first front arm end 76 are attached together between the first plate 80 and the second plate 82. Preferably, the attachment between the loader arm 36, the front arm 38, and the knee 34 is a weld attachment.

The knee 34 includes a first knee rotation axis 84 and a second knee rotation axis 86. Preferably, the first knee rotation axis 84 includes a pin 85 and the second knee rotation axis 86 includes a pin 87. The rotation preferably is provided about the pins 85 and 87. The lift cylinder 40 is provided for generating lift of the attachment 14. The lift cylinder 40 includes a first lift cylinder end 88 and a second lift cylinder end 90. The first lift cylinder end 88 attaches to the tower 30 at the axis 68. The second lift cylinder end 90 attaches to the knee at the first knee rotation axis 84. The attachment cylinder 42 is provided for controlling the movement of the attachment 14. The attachment cylinder 42 includes a first attachment cylinder end 92 and a second attachment cylinder end 94. The first attachment cylinder end 92 is provided attached to the second knee rotation axis 86. The second attachment cylinder end 94 is provided attached to the attachment 14 via the attachment device 48.

The attachment device 48 can be any device that provides connection between the attachment 14 and either or both of the second attachment cylinder end 94 and the second front arm end 78. It should be understood that the attachment device 48 may be a part of the attachment 14 or it may be a separate structure for attaching to the attachment 14. The attachment device 48 can be referred to as a quick attachment device 96 because it provides for convenient attaching and detaching from the attachment 14. Exemplary quick attachment devices are described in U.S. Pat. No. 3,512,665 to Westendorf; U.S. Pat. No. 4,085,856 to Westendorf; U.S. Pat. No. 4,787,811 to Langenfeld et al.; U.S. Pat. No. 4,859,130 to Langenfeld et al.; U.S. Pat. No. 4,915,575 to Langenfeld et al.; and U.S. Pat. No. 4,968,213 to Langenfeld et al. The disclosures of these patents are incorporated herein by reference.

The tower subframe 32 is provided attached to the tower 30. Preferably, the attachment is by welding. The tower subframe 32 includes a first tower subframe end 98 and a second tower subframe end 100. The first tower subframe end 98 attaches to the tower 30, and the second tower subframe end 100 is attached to the attachment arm 46 that is provided for attaching to the front bracket assembly 54. In addition to providing for attachment to the front bracket assembly 54, the tower subframe 32 is constructed to assist in the attachment of the tower 30 to the rear bracket assembly 66.

Now referring to FIG. 3, the operation of the tower 30 and tower subframe 32 is shown during an assembly disassembly operation. The tower 30 and tower subframe 32 are shown in solid lines when attached to a tractor, and are shown in dotted lines detached from a tractor and resting on the ground. The second tower subframe end 100 includes a cap 110 provided for attaching the second tower subframe end 100 to the attachment arm 46. Preferably, the cap 110 is provided within the hollow opening 112 provided within the second tower subframe end 100. Preferably, the cap 110 is welded within the hollow opening 112. The cap 110 is preferably a series of plates 114 welded together to provide sufficient structure for insertion within the hollow opening 112 and for providing secure attachment to the attachment arm 46.

The tower subframe 32 is constructed having a split bracket 102 attached to the subassembly arm 104. The subassembly arm 104 extends from the cap 110 to the tower 30. Preferably, the subassembly arm 104 is welded to the tower 30. The split bracket 102 is provided for reinforcing the connection between the subassembly arm 104 and the tower 30. Preferably, the split bracket 102 is in the form of a Y having a first arm 106 attached to the first tower end 56, and a second arm 107 attached to the second tower end 58. Preferably, the attachment is by welding. The split bracket 102 includes an arm extension 108 that extends along the subassembly arm 104, and is preferably welded to the subassembly arm 104. Preferably, the arm extension 108 is tapered along the subassembly arm 104. This taper, shown in FIG. 3, helps evenly distribute the stress along the subassembly arm 104.

The front end loader 10 is provided in a resting position 120 when the second tower subframe end 100 is provided resting on the ground. The tractor 12 moves forward in the direction of the arrow shown in FIG. 3 and the rear bracket assembly 66 engages the shoe area 64 of the tower 30. Continued movement forward of the tractor 12 causes the tower 30 to move from an inclined position 122 to a relatively vertical position 124. This, in turn, causes lifting of the tower subframe 32 so that the attachment arm 46 can engage the front bracket assembly 54. Once the tower 30 is secured to the rear bracket assembly 66 and the tower subframe 32 is secured to the front bracket assembly 54, the front end loader can be characterized as being in a working position 130. In order to detach the front end loader 10 from the tractor 12, the steps are reversed. That is, the tower 30 is released from the rear bracket assembly 66, the tower subframe 32 is released from the front bracket assembly 54, and the tractor is backed away from the front end loader 10. It should be understood that the pneumatic lines for operating the lift cylinder 40 and the attachment cylinder 42 are not shown. The pneumatic lines are generally attached to the tractor and the cylinder. Accordingly, in order to attach and detach the front end loader, it is often appropriate to attach or detach the pneumatic lines. In general, the pneumatic lines can be attached prior to attaching the front end loader 10 to the tractor, and can be detached just after detaching the front end loader 10 from the tractor 12.

Now referring to FIG. 2, the loader 10 includes a valve cover 120 provided attached to the right boom arm 22 at the first tower end 56'. The valve cover 120 is generally provided for covering the valves associated with the pneumatic lines. In addition, a lever (not shown) can be provided in association with the valve cover 120 to operate the cylinders.

Figure 4:
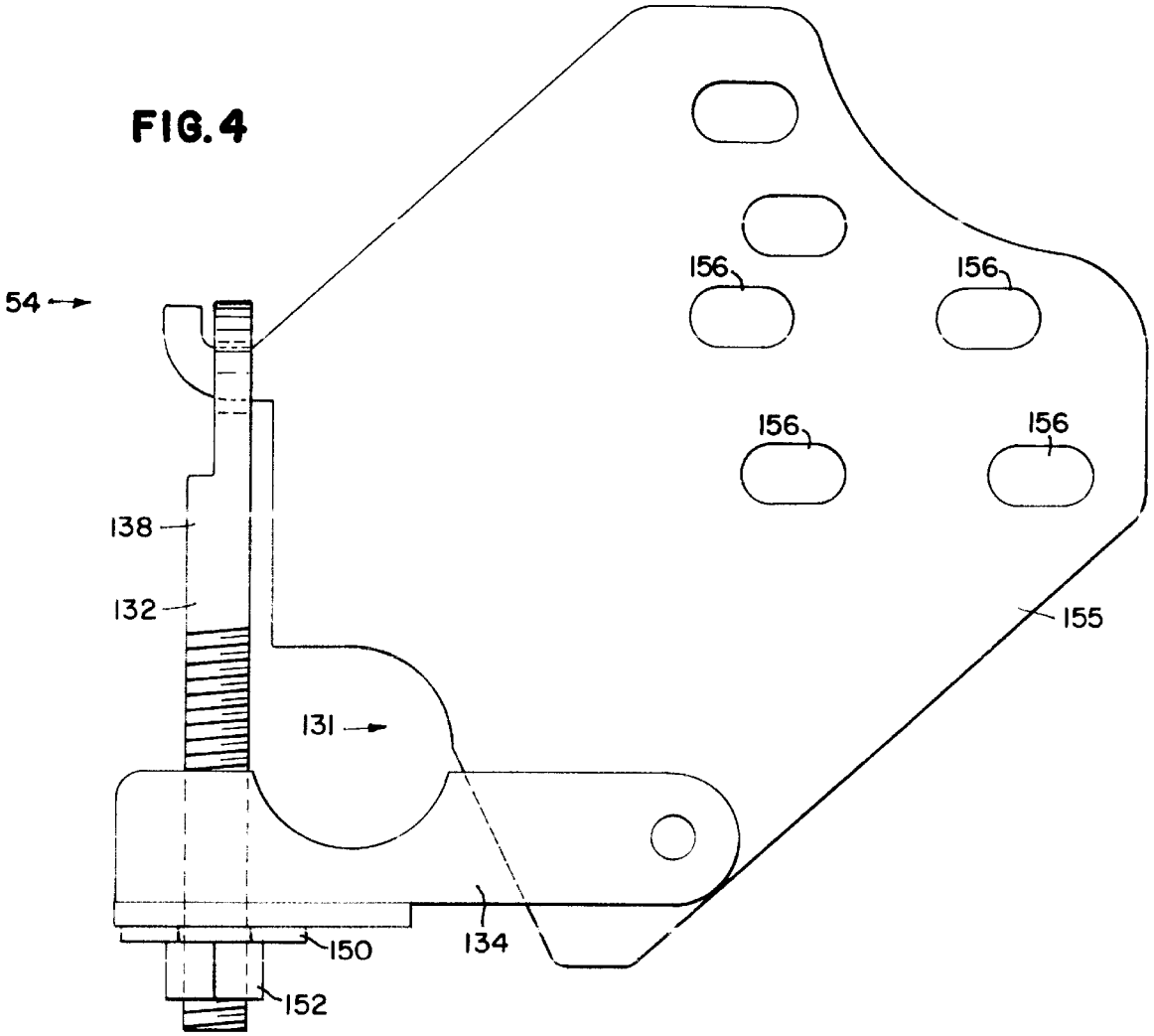
FIG. 4 is a side view of the front bracket for attaching the front end loader of FIG. 1 to the tractor.
Figure 5:
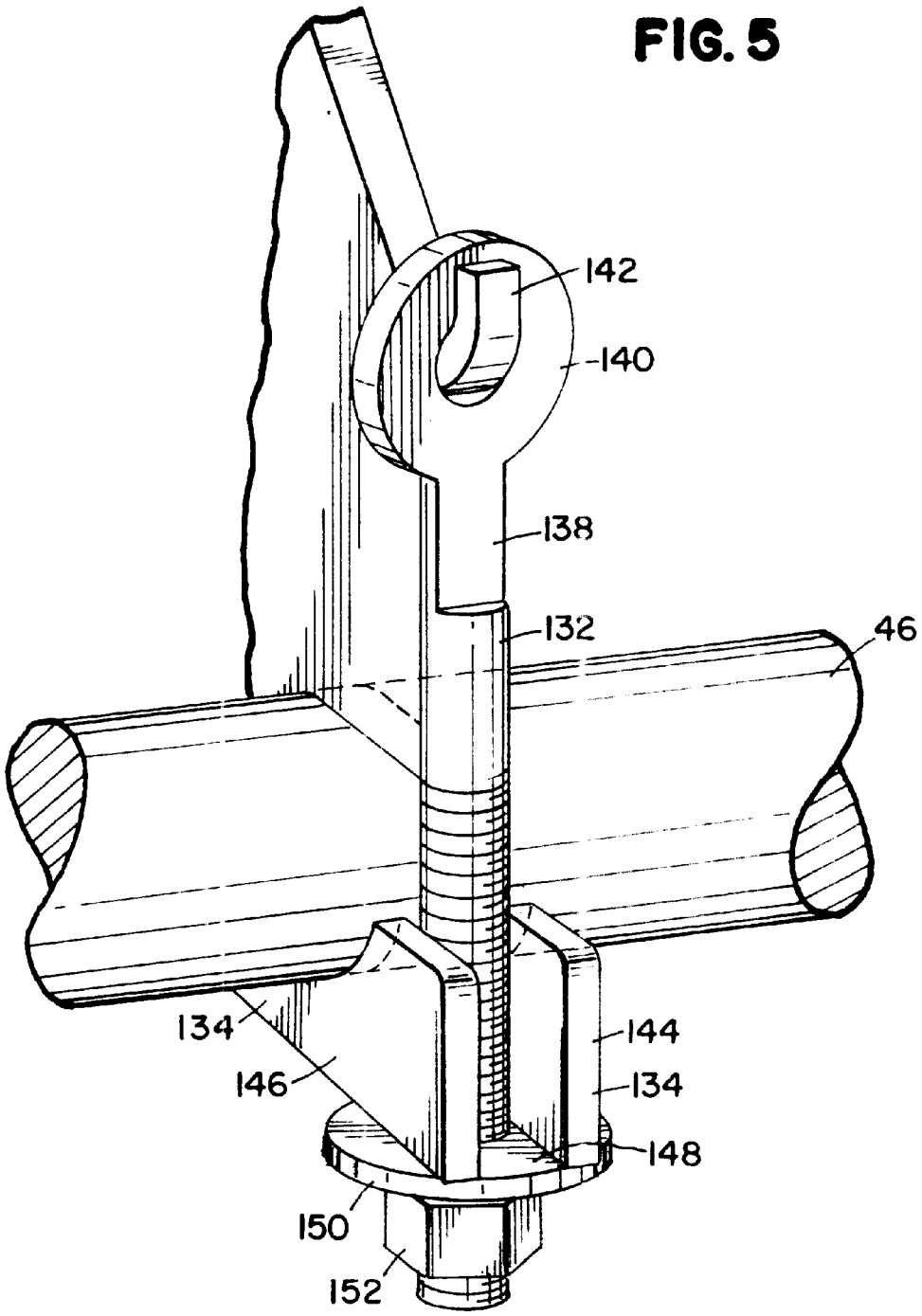
FIG. 5 is a perspective view of the front bracket for attaching the front end loader of FIG. 1 to the tractor.
Figure 6:
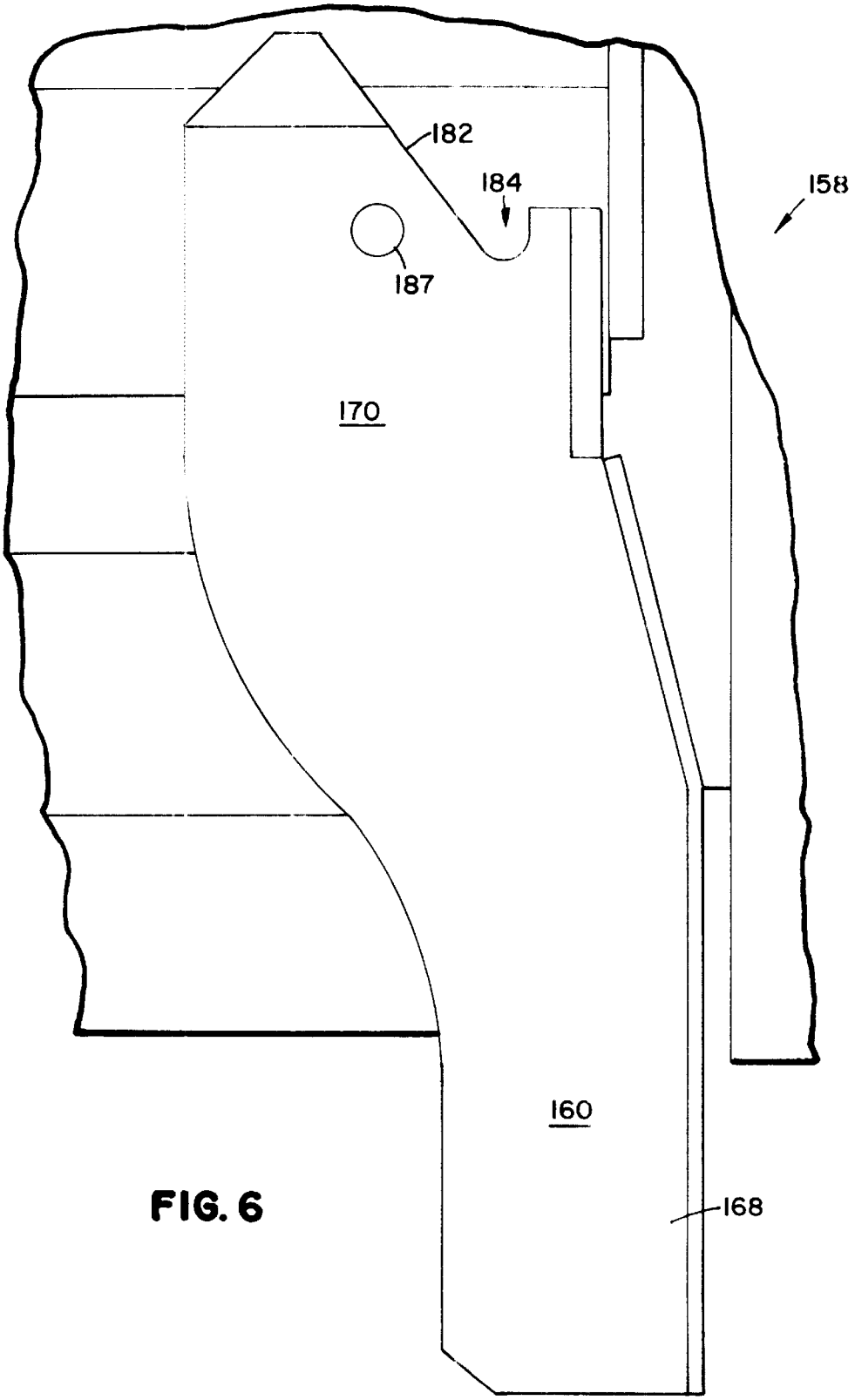
FIG. 6 is a side view of a rear bracket for attaching the front end loader of FIG. 1 to the tractor.
Figure 7:
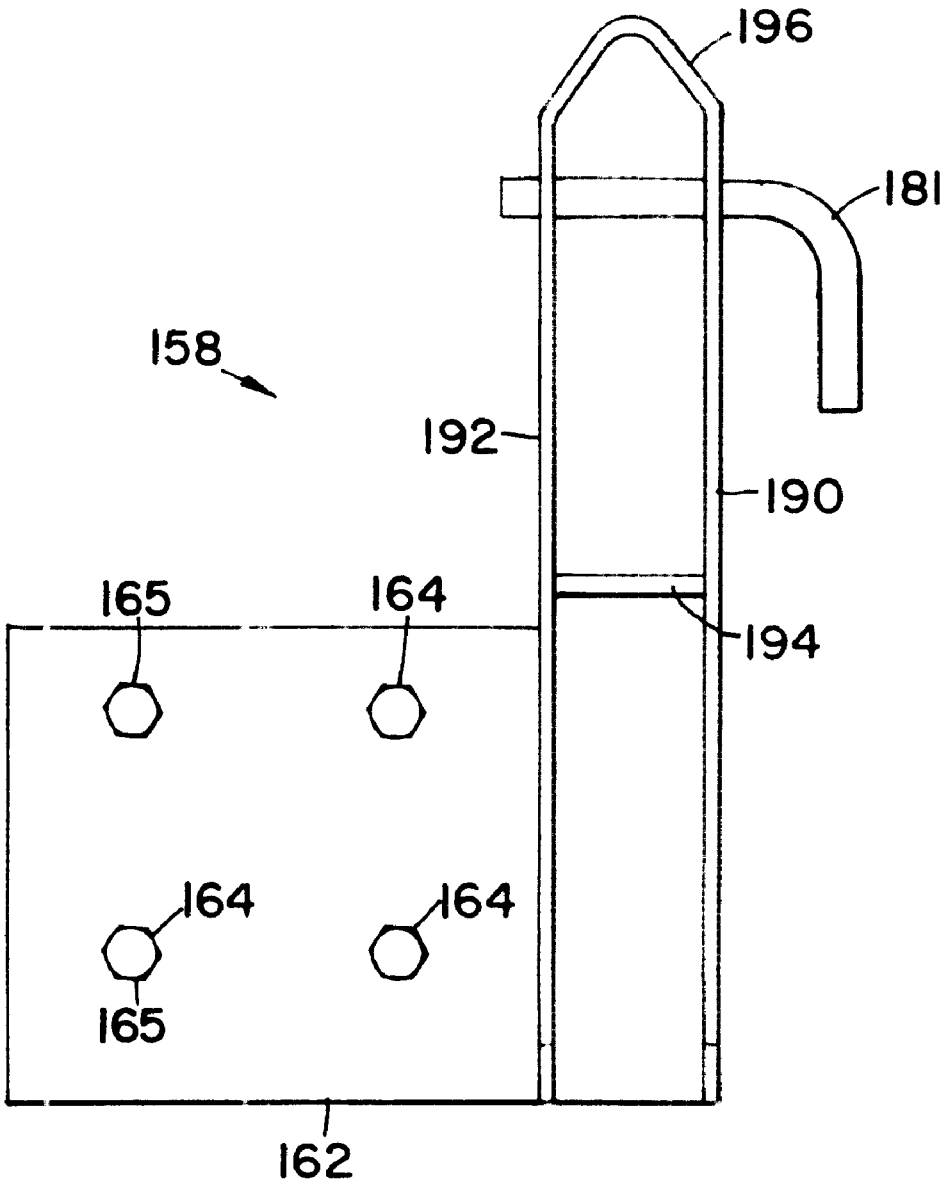
FIG. 7 is a side view of a rear bracket for attaching the front end loader of FIG. 1 to a tractor.

Now referring to FIGS. 4–5, the operation of the front bracket assembly 54 is shown in detail. During the attachment process, the attachment arm 46 moves into the attachment arm receiving area 131. During attachment, the bolt 132 is removed and the swing arm 134 rotates about the swing arm axis 136. Accordingly, once the attachment arm 46 is provided within the attachment arm receiving area 131, the swing arm 134 is rotated upward to engage the attachment arm 46, and the bolt 132 is replaced and attached to hold the swing arm 134 in place. Preferably, the bolt 132 is an I-bolt 138 having an I portion 140 that threads over a hanger 142. The bolt 132 then extends between the first side 144 and the second side 146 of the swing arm 134. The swing arm 134 includes a slotted area 148 that allows the bolt to move between the first side 144 and the second side 146. A washer 150 and a nut 152 can be provided for holding the bolt 132 in place. Although a bolt is shown holding the swing arm 134 in place, it should be appreciated that any other fastening mechanism can be used for holding the swing arm 134 in place in order to contain the attachment arm 46 within the attachment arm receiving area 131.

The front bracket assembly 54 includes a bracket member 155 for attachment to the tractor 12. The bracket member 155 includes openings 156 for receiving fasteners for attaching the bracket member 155 to the tractor 12. Preferably, the fasteners include bolt and nut type fasteners.

Now referring to FIGS. 6–10, the operation of exemplary rear bracket assemblies are shown in detail. The rear bracket assembly 158 includes a post 160 and a bracket member 162 for attaching the post 160 to the tractor. Preferably, the bracket member 162 is attached to the tractor by fasteners 164 such as nut and bolt type fasteners 165.

The post 160 includes a bracket attachment region 168 and a shoe-receiving region 170. The bracket attachment region 168 attaches to the bracket member 162. The shoe-receiving region 170 is constructed to fit within the shoe area 64 of the tower 30. As shown in FIGS. 1 and 2, the tower 30 is generally constructed to provide a bottom opening 172. The opening 172 provides for insertion of the shoe-receiving region 170 therein. The tower is preferably provided as a three-sided structure 174. In addition, the tower includes a fixed pin 180 and a removable pin 181. During the process of attaching the loader 10 to the tractor, the shoe-receiving area 170 engages the shoe area 64 of the tower 30. The fixed pin 180 engages the receiving surface 182 and moves along the receiving surface 182 until it reaches the fixed pin-receiving area 184. The fixed pin-receiving area 184 is provided to align the tower 30 both vertically and horizontally over the shoe-receiving region 170. The removable pin 181 can then be inserted into the opening 185 provided on the tower and engage the opening 187 provided in the shoe-receiving region 170. A cotter pin can then be used to keep the removable pin 181 in place. Once the removable pin 181 is provided extending through both sides of the tower 30, the tower is attached to the rear bracket assembly.

The post 160 is preferably provided having a first side 190 and a second side 192 that is separated by a distance that is sufficient to lock the tower 30 in place over the shoe-receiving region 170. The sides 190 and 192 can be attached by the support structure 194. In addition, the sides 190 and 192 can be attached by a peak or cap 196. The peak or cap 196 helps guide the tower 30 over the shoe-receiving region 170. The removable pin 181 and the fixed pin 180 extend between the sides 190 and 192.

Figure 8A:
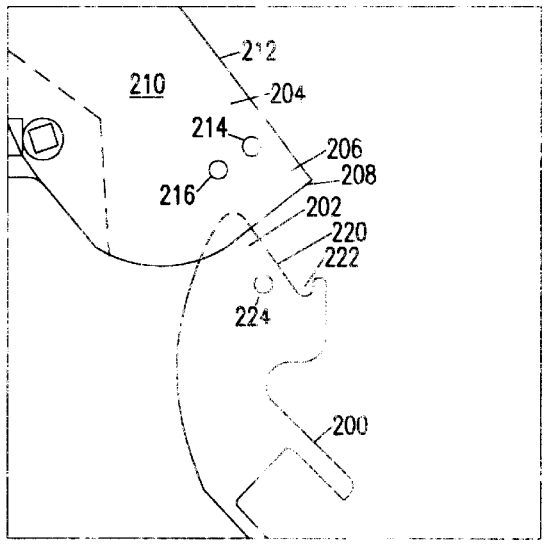
FIGS. 8(*a*)–(*c*) is a side view showing the attachment of a tower to a rear bracket according to principles of the invention.
Figure 8B:
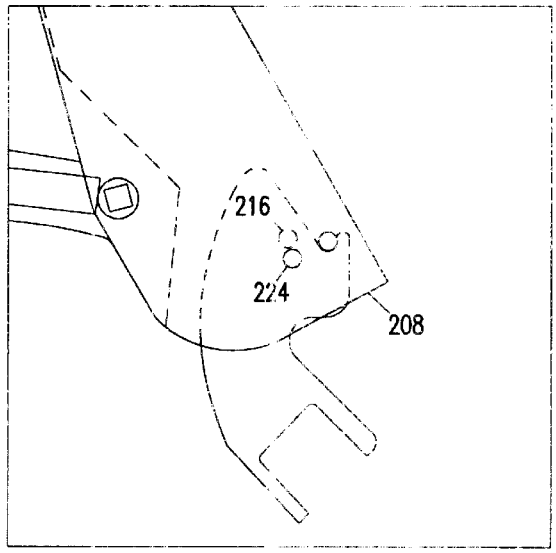
Figure 8C:
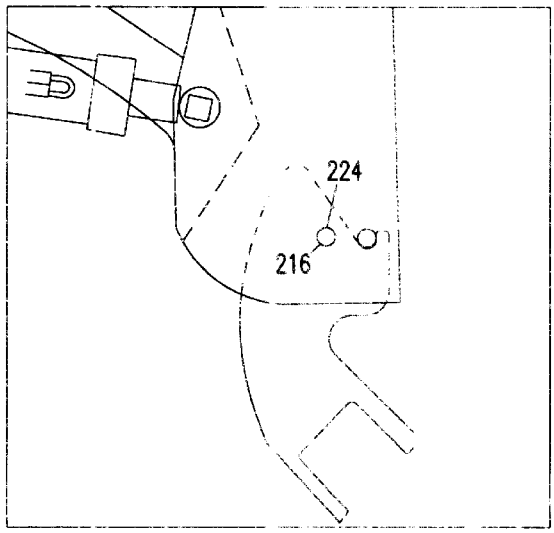
Figure 9A:
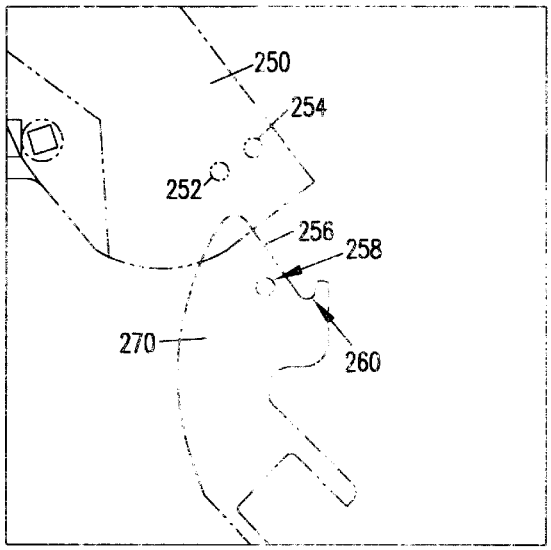
FIGS. 9(*a*)–(*c*) is a side view showing the attachment of a tower to a rear bracket according to principles of the invention.
Figure 9B:
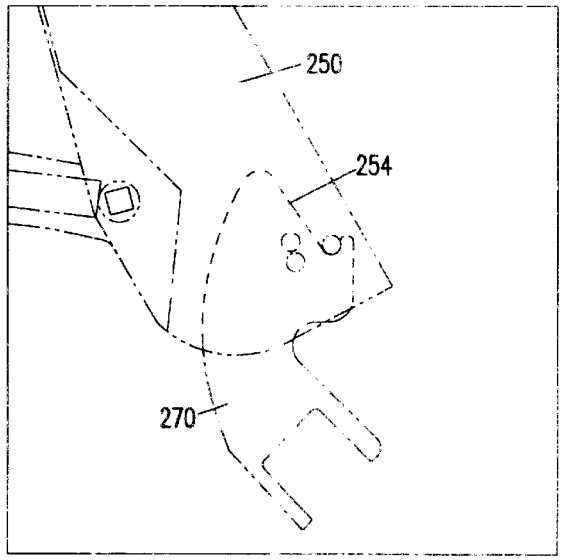
Figure 9C:
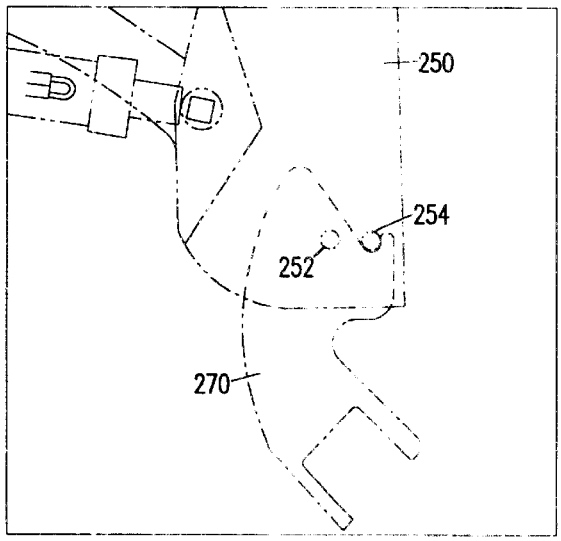
Figure 10A:
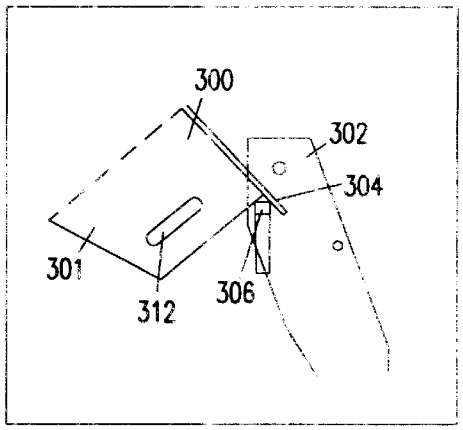
FIGS. 10(*a*)–(*d*) is a side view showing the attachment of a tower to a rear bracket according to principles of the invention.
Figure 10B:
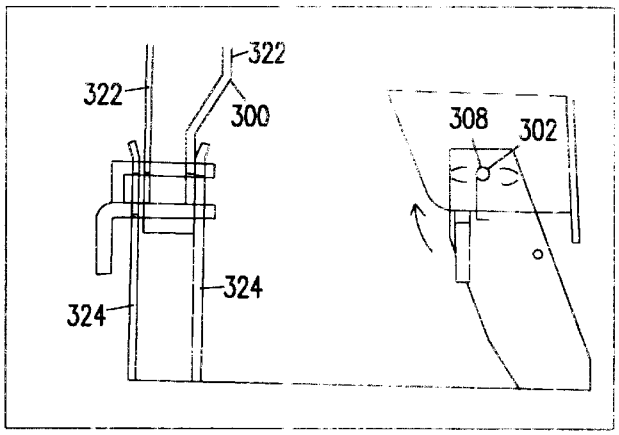
Figure 10C:
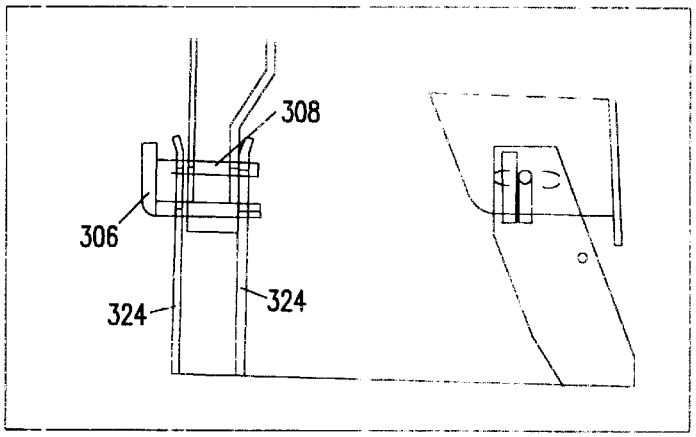
Figure 10D:
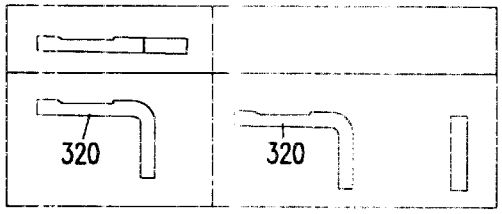

Alternative techniques for attaching the tower to the rear bracket assembly are exemplified in FIGS. 8–10. The technique shown in FIGS. 8(*a*)–(*c*) is similar to the technique identified above with respect to FIGS. 6 and 7. The bracket 200 is provided attached to a tractor, and includes a shoe-receiving area 202. The tower 204 is provided with a shoe area 206 that fits over the shoe-receiving area 202. The shoe area 206 includes a bottom opening 208, and the tower 204 includes at least three sides. The first side 210 is shown, the second side is opposite the first side 210, and the third side 212 is shown. The tower 204 includes a fixed pin 214, and an opening 216. As the bottom opening 208 fits over the shoe-receiving region 202, the fixed pin 214 engages the receiving surface 220 and moves along the receiving surface 220 until it reaches the pin receiving area 222. The tower 204 continues to rotate until it is positioned correctly, both horizontally and vertically, over the shoe-receiving area 202. A removable pin can then be inserted through the opening 216 and the opening 224. The openings 216 and 224 are shown aligned in FIG. 8(*c*).

Now referring to FIG. 9, a tower 250 is provided having two fixed pins 252 and 254. The fixed pin 252 engages the receiving surface 256 and follows the receiving surface 256 until it engages the first fixed pin receiving area 258. The tower 250 continues to rotate until the second fixed pin 254 engages the second fixed pin receiving area 260. The tower 250 is then held over the shoe-receiving region 270 by the attachment of the attachment arm to the front bracket assembly.

Now referring to FIGS. 10(*a*)–(*d*), an additional embodiment showing the attachment of the tower 300 to a bracket assembly 302 is provided. FIGS. 10(*b*) and (*c*) include front and side views. In this embodiment, the tower 300 includes a shoe area 301 that fits and is received within the bracket assembly 302. The tower includes a receiving surface 304 that engages a rotation pin as the tower 300 rotates into the bracket assembly 302. The rotation pin 306 guides the tower 300 into position within the bracket assembly 302 as the tower 300 continues to rotate. Once the tower 300 is provided in the appropriate position, a removable pin 308 is then inserted within the opening 310 provided in the bracket assembly 302 and the opening 312 provided in the tower. The rotation pin 306 can then be rotated in the direction shown by the arrow to lock the tower 300 in place. The rotation pin 306 preferably includes a cam region 320 which, when the rotation pin 306 rotates, causes a compression of the tower walls 322 against the bracket assembly walls 324.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A front end loader comprising:

(a) a tower having a first tower end and a second tower end;

(i) the second tower end including a shoe area for attaching to a shoe-receiving region provided on a first bracket assembly attached to a tractor;

(ii) the shoe area comprising a bottom opening constructed to fit over the shoe-receiving region and comprising two fixed pins within the shoe area for aligning the shoe-receiving region within the shoe area;

(b) a tower subframe having a first tower subframe end and a second tower subframe end;

(i) the first tower subframe end being attached to the tower;

(ii) the second tower subframe end being constructed for attachment to a second bracket assembly attached to a tractor;

(c) a knee having a first knee rotation axis and a second knee rotation axis;

(d) a loader arm having a first loader arm end and a second loader arm end;

(i) the first loader arm end being rotatably attached to the first tower end of the tower;

(ii) the second loader arm end being attached to the knee;

(e) a front arm having first front arm end and a second front arm end;

(i) the first front arm end being attached to the knee;

(ii) the second front arm end being rotatably connectable to an attachment;

(f) a lift cylinder having a first lift cylinder end and a second lift cylinder end;

(i) the first lift cylinder end being rotatably connected to the second tower end of the tower;

(ii) the second lift cylinder end being attached to the first knee rotation axis of the knee; and (g) an attachment cylinder having a first attachment cylinder end and a second attachment cylinder end;

(i) the first attachment cylinder end being attached to the second knee rotation axis of the knee; and (ii) the second attachment cylinder end being rotatably connectable to an attachment.

2. A front end loader according to claim 1, further comprising an attachment device rotatably attached to the second front arm end of the front arm and to the second attachment cylinder end of the attachment cylinder, the attachment device including a surface for attaching to an attachment.

3. A front end loader according to claim 2, wherein the attachment device is attached to a bucket.

4. A tractor comprising front end loader, the front end loader comprising:

(a) a tower having a first tower end and a second tower end;

(i) the second tower end including a shoe area attached to a shoe-receiving region provided on a first bracket assembly attached to the tractor;

(ii) the shoe area comprising a bottom opening constructed to fit over the shoe-receiving region and comprising two fixed pins within the shoe area for aligning the shoe-receiving region within the shoe area;

(b) a tower subframe having a first tower subframe end and a second tower subframe end;

(i) the first tower subframe end being attached to the tower;

(ii) the second tower subframe end being attached to a second bracket assembly attached to the tractor;

(c) a knee having a first knee rotation axis and a second knee rotation axis;

(d) a loader arm having a first loader arm end and a second loader arm end;

(i) the first loader arm end being rotatably attached to the first tower end of the tower;

(ii) the second loader arm end being attached to the knee;

(e) a front arm having first front arm end and a second front arm end;

(i) the first front arm end being attached to the knee;

(ii) the second front arm end being rotatably connectable to an attachment;

(f) a lift cylinder having a first lift cylinder end and a second lift cylinder end;

(i) the first lift cylinder end being rotatably connected to the second tower end of the tower;

(ii) the second lift cylinder end being attached to the first knee rotation axis of the knee; and (g) an attachment cylinder having a first attachment cylinder end and a second attachment cylinder end;

(i) the first attachment cylinder end being attached to the second knee rotation axis of the knee; and (ii) the second attachment cylinder end being rotatably connectable to an attachment.

5. A method for attaching a front end loader on a tractor, the method comprising steps of:

driving a tractor into a stationary front end loader, the front end loader comprising:

(a) a tower having a first tower end and a second tower end;

(i) the second tower end including a shoe area for attaching to a shoe-receiving region provided on a first bracket assembly attached to the tractor;

(ii) the shoe area comprising a bottom opening constructed to fit over the shoe-receiving area and comprising two fixed pins within the shoe area for aligning the shoe-receiving region within the shoe area;

(b) a tower subframe having a first tower subframe end and a second tower subframe end;

(i) the first tower subframe end being attached to the tower;

(ii) the second tower subframe end being constructed for attachment to a second bracket assembly attached to the tractor;

(c) a knee having a first knee rotation axis and a second knee rotation axis;

(d) a loader arm having a first loader arm end and a second loader arm end;

(i) the first loader arm end being rotatably attached to the first tower end of the tower;

(ii) the second loader arm end being attached to the knee;

(e) a front arm having first front arm end and a second front arm end;

(i) the first front arm end being attached to the knee;

(ii) the second front arm end being rotatably connectable to an attachment;

(f) a lift cylinder having a first lift cylinder end and a second lift cylinder end;

(i) the first lift cylinder end being rotatably connected to the second tower end of the tower;

(ii) the second lift cylinder end being attached to the first knee rotation axis of the knee; and (g) an attachment cylinder having a first attachment cylinder end and a second attachment cylinder end;

(i) the first attachment cylinder end being attached to the second knee rotation axis of the knee; and (ii) the second attachment cylinder end being rotatably connectable to an attachment; and attaching the second tower end to the shoe-receiving region provided on the first bracket assembly, and attaching the second tower subframe end to the second bracket assembly.

6. A front end loader comprising:

(a) a tower having a first tower end and a second tower end;

(i) the second tower end including a shoe area for attaching to a shoe-receiving region provided on a first bracket assembly attached to a tractor;

(ii) the shoe area comprising a bottom opening constructed to fit over the shoe-receiving region and comprising multiple pins fixed within the shoe area for aligning the shoe-receiving region within the shoe area; and (b) a tower subframe having a first tower subframe end and a second tower subframe end;

(i) the first tower subframe end being attached to the tower;

(ii) the second tower subframe end being constructed for attachment to a second bracket assembly attached to a tractor.

7. A tractor comprising front end loader, the front end loader comprising:

(a) a tower having a first tower end and a second tower end;

(i) the second tower end including a shoe area attached to a shoe-receiving region provided on a first bracket assembly attached to the tractor;

(ii) the shoe area comprising a bottom opening constructed to fit over the shoe-receiving region and comprising multiple pins fixed within the shoe area for aligning the shoe receiving region within the shoe area; and (b) a tower subframe having a first tower subframe end and a second tower subframe end;

(i) the first tower subframe end being attached to the tower;

(ii) the second tower subframe end being attached to a second bracket assembly attached to the tractor.

8. A method for attaching a front end loader on a tractor, the method comprising steps of:

driving a tractor into a stationary front end loader, the front end loader comprising:

(a) a tower having a first tower end and a second tower end;

(i) the second tower end including a shoe area for attaching to a shoe-receiving region provided on a first bracket assembly attached to the tractor;

(ii) the shoe area comprising a bottom opening constructed to fit over the shoe-receiving area and comprising multiple pins fixed within the shoe area for aligning the shoe-receiving region within the shoe area; and (b) a tower subframe having a first tower subframe end and a second tower subframe end;

(i) the first tower subframe end being attached to the tower;

(ii) the second tower subframe end being constructed for attachment to a second bracket assembly attached to the tractor; and (iii) attaching the second tower end to the shoe-receiving region provided on the first bracket assembly, and attaching the second tower subframe end to the second bracket assembly.

* * * * *